US006788211B2

(12) United States Patent
Kouznetsov et al.

(10) Patent No.: US 6,788,211 B2
(45) **Date of Patent: *Sep. 7, 2004**

(54) APPARATUS AND METHOD USING SMOKE AND/OR GAS SENSING IN COOKING DEVICES

(75) Inventors: Andrian Kouznetsov, Santa Barbara, CA (US); Anthony Jenkins, Lompoc, CA (US)

(73) Assignee: Edwards Systems Technology, Inc., Cheshire, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/778,836

(22) Filed: Feb. 8, 2001

(65) Prior Publication Data

US 2001/0052852 A1 Dec. 20, 2001

Related U.S. Application Data

(63) Continuation-in-part of application No. 09/593,341, filed on Jun. 14, 2000, now Pat. No. 6,285,290.

(51) Int. Cl.[7] ..... G08B 17/10

(52) U.S. Cl. ..... 340/630; 340/628; 219/393; 250/574; 356/438; 432/120

(58) Field of Search ..... 340/628, 630, 340/632; 219/393; 356/438; 432/120; 250/574

(56) References Cited

U.S. PATENT DOCUMENTS

| | | | | | |
|---|---|---|---|---|---|
| 4,481,404 | A | | 11/1984 | Thomas et al. | 219/398 |
| 4,831,239 | A | * | 5/1989 | Ueda | 340/686 |
| 4,930,488 | A | * | 6/1990 | Pearman et al. | 126/39 E |
| 5,369,253 | A | * | 11/1994 | Kuwata et al. | 219/707 |
| 5,493,119 | A | | 2/1996 | Torngren | 250/343 |
| 5,814,794 | A | * | 9/1998 | Lim | 219/685 |
| 5,847,261 | A | * | 12/1998 | Lee | 73/1.07 |
| 6,037,580 | A | | 3/2000 | Renk | 250/221 |
| 6,285,290 | B1 | * | 9/2001 | Kouznetsov | 340/628 |

FOREIGN PATENT DOCUMENTS

| | | | |
|---|---|---|---|
| EP | 0 394 009 | 4/1990 | |
| WO | 86/00179 | 6/1985 | |
| WO | WO 01/00073 A1 | 5/2000 | A47J/37/08 |

* cited by examiner

*Primary Examiner*—Benjamin C. Lee
(74) *Attorney, Agent, or Firm*—Baker & Hostetler LLP

(57) ABSTRACT

A control device and method provides control of at least one operating feature of a cooking device in response to measured smoke and/or gas produced by item(s) being cooked. The device and method may control the temperature and cooking time of the device, and may also shut off the device or provide a fire alarm.

25 Claims, 1 Drawing Sheet

APPARATUS AND METHOD USING SMOKE AND/OR GAS SENSING IN COOKING DEVICES

PRIORITY

This application is a continuation-in-part and claims priority to the U.S. patent application entitled, Self-Cleaning Oven Having Smoke Detector For Limiting Cleaning Cycle, filed Jun. 14, 2000, in the name of Andrian Kouznetsov having a Ser. No. 09/593,341, now U.S. Pat. No. 6,285,290, and the U.S. patent application Ser. No. 09/777,993 entitled, A Gas Sensor Based On Energy Absorption, filed Feb. 6, 2001, in the name of Andrian Kouznetsov, now Publication No. 20020104967, the disclosures of both of which are hereby incorporated by reference.

FIELD OF THE INVENTION

The present invention relates generally to improved methods and apparatus for cooking foods. More particularly, the present invention relates to control of various operational functions of a cooking device such as, for example, temperature, time, and/or alarm functions. More particularly, the invention pertains to such control using measurement of parameters such as, for example, detecting and measuring at least a portion of the smoke generated by the item(s) being cooked in the oven and/or detecting and measuring the presence of at least a portion of gases generated during the cooking process.

BACKGROUND OF THE INVENTION

Many household and industrial devices, such as ovens, toasters bread machines and the like are used for cooking food. A problem with conventional devices is that they typically operate by having a user set a cooking temperature and/or cooking time. The user may inadvertently set one of these settings incorrectly for the food being cooked. For example, if the temperature is set too high, and/or the cooking time is set too long, then the food will burn undesirably, which can ruin the food, cause unwanted smoke to build up in the device, and/or present a fire hazard. Also, food burning can begin to occur before any smoke is noticeable to an operator in the vicinity of the cooking device. Further, with the ability of Internet enabled cooking devices that can be remote controlled, it is desirable to enhance the safety of such devices by providing increased monitoring and safety control.

Accordingly, it is desirable to provide a method and apparatus that can control various operational functions of a cooking device such as, for example, temperature, time, and alarm functions, to prevent or reduce burning of the item(s) being cooked.

SUMMARY OF THE INVENTION

It is therefore a feature and advantage of the present invention to provide control of at least one operating feature of a cooking device in response to measured smoke and/or gas produced by item(s) being cooked. The above and other features and advantages are achieved through the use of a novel apparatus and method as herein disclosed.

In accordance with one embodiment of the present invention, the invention operates by measuring during cooking a parameter of at least a portion of the smoke generated by the item(s) being cooked, and by controlling an operating feature of the cooking device in response to such measurement. The feature being controlled may be the device temperature, the cooking time, activation of an alarm and/or a fire suppression feature. The preferred controlling assembly of the invention may include a sensing chamber together with a delivery system (e.g., a passageway) communicating the cooking device interior and the sensing chamber in order to convey at least a portion of the smoke evolved during the cooking cycle to the sensing chamber. A smoke detector is associated with the sensing chamber in order to measure the smoke parameter of interest. Advantageously, the smoke detector may be a conventional infrared smoke detector which is coupled with an electronic controller, in order to measure the a parameter of smoke generated during at least a portion of the cooking cycle. Also, an in-line smoke filter may be interposed in the delivery system to remove the largest smoke particles. This reduces the rate of smoke contamination of the sensor chamber and other components.

In another embodiment, the present invention uses a gas sensor operable to measure during cooking a parameter of at least a portion of the gas generated by the item(s) being cooked, and by controlling an operating function of the cooking device in response to such measurement. The cooking device function being controlled may be the temperature, the cooking time, activation of an alarm and/or a fire suppression feature. The gas being measured is preferably $CO_2$, although other gases may be measured. The preferred gas sensor operates under the principle of infrared absorption, which states that a gas will proportionally absorb infrared radiation or other radiant energy having particular characteristics, such as a particular wavelength or range of wavelengths. Thus, by exposing the gas sample to infrared energy having the appropriate characteristics with regard to the gas component of interest, and measuring the amount of unabsorbed radiation, the amount of the particular gas component can be determined as being proportional to the difference between the amount of sourced radiation and the amount of detected radiation. In a preferred form, the detector's measurement is compared to a predetermined reference value, with the reference value being established under known conditions, such as the absence of the gas of interest.

Preferably, the following parameters may be used in control of the cooking process: oven temperature, level of smoke, levels of CO, $CO_2$, and/or $H_2O$. Different cooking devices may use some or all of these parameters. Temperature may be measured by the oven control. The sensor(s) will be able to measure any one (or any combination) of the rest of the parameters.

The oven control function, that depends on the value of the measured parameters can be generated by either the sensor or the oven controller. Normally the oven controller is a separate unit within the cooking device. It is possible that the sensor and oven controller will be integrated into a single unit. This depends on which implementation provides lower overall cooking device cost.

Although some embodiments use IR gas sensing devices, the particular gas sensing method can be selected based on various factors such as a cost/performance combination. In some embodiments, IR-absorption gas sensing devices are preferred because of their reliability and long life time.

There has thus been outlined, rather broadly, the more important features of the invention in order that the detailed description thereof that follows may be better understood, and in order that the present contribution to the art may be better appreciated. There are, of course, additional features of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein, as well as the abstract included below, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

Preferred embodiments of the present invention are described in detail below with reference to the attached drawing figures, wherein.

DETAILED DESCRIPTION OF PREFERRED EMBODIMENTS OF THE INVENTION

Figure 1:
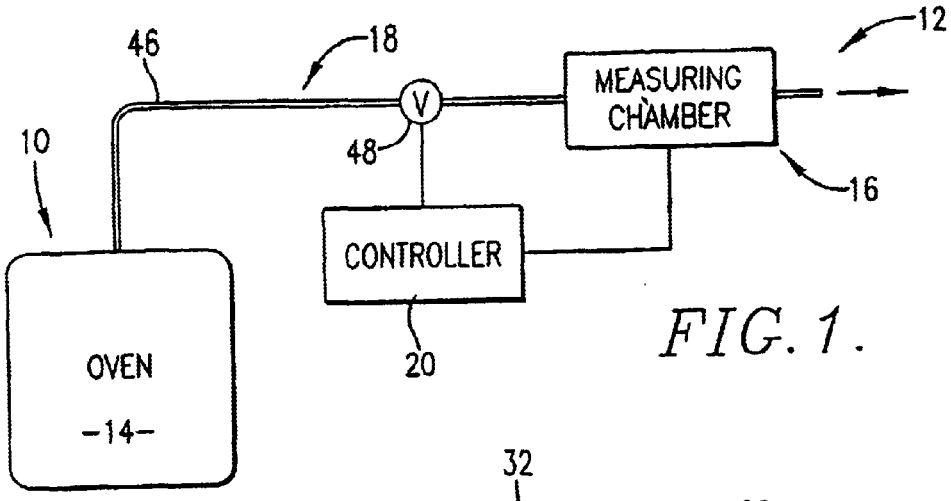
FIG. 1 is a schematic representation of an oven with the preferred cooking device controlling assembly of the invention coupled thereto.

In accordance with preferred embodiments of the present invention, the invention operates by measuring a parameter of at least a portion of the smoke and/or gas (such as CO2) generated during cooking, and by controlling an operating feature of the cooking device in response to such measurement. Although an oven is described as one cooking device in the description herein, the invention is applicable to control of any cooking device, including for example toasters, toaster ovens, bread machines, microwave ovens and other devices.

The cooking device function being controlled may be, for example, the temperature, the cooking time, a door lock, activation of an alarm and/or a fire suppression feature. The preferred controlling assembly of the invention may include a sensing chamber together with a delivery system (e.g., a passageway) communicating the oven interior and the sensing chamber in order to convey at least a portion of the smoke and/or gas (such as CO2) emitted during cooking to the sensing chamber. A smoke and/or gas detector is associated with the sensing chamber in order to measure the smoke and/or gas parameter of interest, and is coupled with an electronic controller, in order to measure a parameter of smoke and/or gas generated during cooking. Also, an in-line smoke filter may be interposed in the delivery system to remove the largest smoke particles. This reduces the rate of smoke contamination of the sensor chamber and other components. To further reduce the contamination of the sensor the electronically controlled valve can be interposed in the passageway.

The sensing and measuring of smoke and/or gas generated during cooking is used to control any one or more of various oven functions. For example, where the cooking temperature is inadvertently set too high for a certain food, the food will begin emitting a smoke and/or gas level that is higher than normal for food cooking. The smoke and/or gas detector can rapidly detect the high level of smoke and/or gas and the controller responds by reducing the oven temperature until the smoke and/or gas level decreases to a normal level. The smoke and/or gas detector can be programmed to reduce the temperature gradually where only moderately high smoke and/or gas is measured, and can reduce the temperature more rapidly where very overly high smoke and/or gas is measured.

Another operation of the invention occurs where food is being cooked at a proper temperature, but the duration of the cooking cycle is overly long. This could occur due to a time being programmed too long, or the oven being left on without a timer operating. Upon overly long cooking, the food will begin emitting a smoke and/or gas level that is higher than normal for food cooking. The smoke and/or gas detector can rapidly detect the high level of smoke and/or gas and the controller responds by reducing the oven temperature or shutting the oven heating off entirely.

Besides controlling the oven temperature and time, the controller can activate an alarm or fire-suppression feature. For example, if a fire occurs in the oven during cooking, the smoke and/or gas detector can detect this due to the smoke and/or gas being at a certain level. The controller then activates an alarm, and can lock the oven door shut or activate other fire-suppression features. The controller can shot off fuel gas flow to the burner, and/or electricity to heating elements. The controller can also report any of its functions, including the fire-related functions, to a remote location if the oven is in communication with a remote location by, for example, a telephone or network connection such as an internet or wireless connection.

The smoke and/or gas detectors can in some embodiments detect food burning before it would be observable to an operator. For example the detecting device can detect smoke levels from burning before they would be observable escaping from and oven vent or exhaust.

The smoke and/or gas measurements can be used not only to detect food burning, but can also be used to control the cooking temperature to avoid food burning. The controller may be programmed to detect overcooking and if desired to avoid food overcooking. The controller may be programmed to provide optimal food cooking based on measurement of smoke and/or gas.

Turning now to the drawings, FIG. 1 illustrates an oven 10 in combination with the oven-controlling assembly 12 of the invention. Broadly speaking, the oven 10 is itself conventional and presents an interior 14. The oven 10 may be of the variety which is controlled by conventional control and timing electronics. The assembly 12 includes a measuring chamber 16 as well as a delivery system 18 which communicates oven interior 14 and the chamber 16. A controller 20 also forms a part of the assembly 12.

Figure 2:
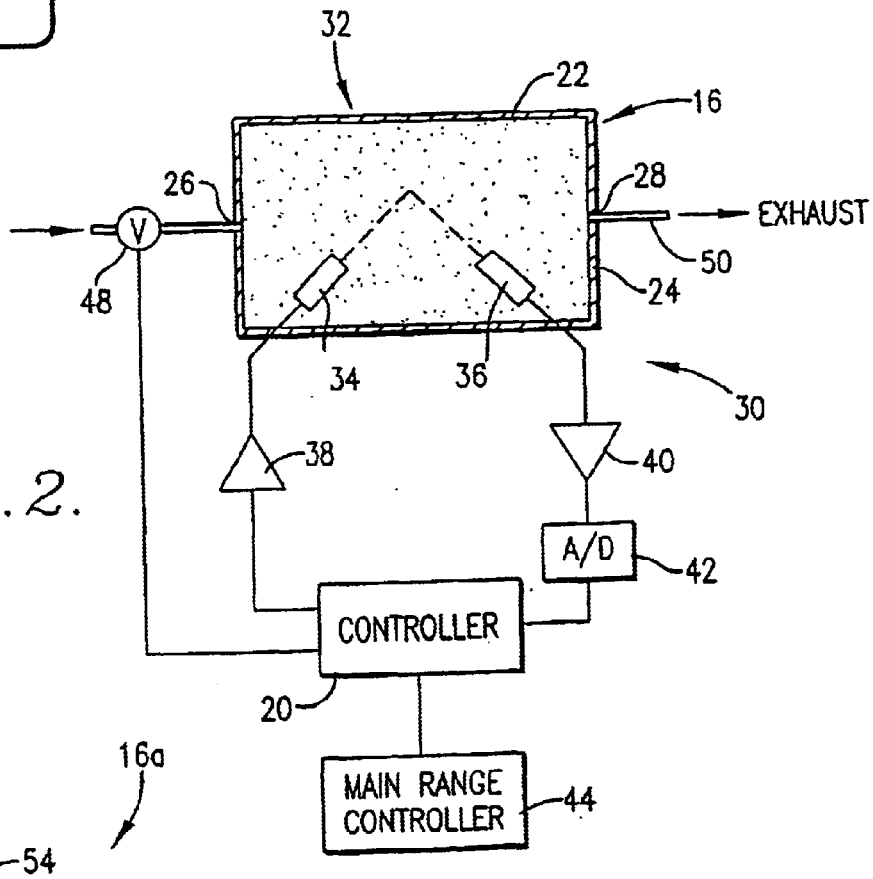
FIG. 2 is a schematic view illustrating the preferred construction of a smoke measuring chamber forming a part of the cooking device controlling assembly.

In more detail, in an embodiment using a smoke detector, it is preferred that the measuring chamber 16 is preferably molded from high temperature-rated synthetic resin materials and is in the form of small tubular or boxlike enclosure 22 presenting exterior walls 24 as well as an oven gas inlet 26 and an opposed oven gas outlet 28. The chamber 16 is equipped with a sensor 30 in the form of an infrared smoke detector 32. The detector 32 includes an infrared light emitting diode (LED) 34 as well as a spaced infrared detector 36. The LED 34 and detector 36 are placed within the enclosure 22 and are oriented so that smoke passing through the chamber 16 will be detected. As illustrated in FIG. 2, these components are angularly disposed relative to each other so that infrared radiation emitted by LED 34 will be scattered by the smoke (usually containing solid particles and various types of volatile organic compounds (VOCs)), and a portion of such scattered radiation is detected by the detector 36.

It will be understood that the enclosure 22 illustrated in the drawings is of simplified design. In practice, the enclosure may simply be of tubular configuration with a diameter similar to that of the tube 46, so that the volume of the enclosure is less than that of the delivery system 18. Also, the chamber may include provision for preventing LED radiation from reaching the IR detector when there is no smoke within the enclosure. Such may include special wall shapes, internal partitions, or IR black coating on the interior of the chamber. Also, the enclosure may have provision for verification for smoke sensor performance, such as a special opening that allows insertion of a calibrated scattering media (such as a simple piece of plastic or fabric) instead of smoke.

The controller 20 is connected to the LED 34 and detector 36 for control thereof. Specifically, the controller is electrically coupled to an infrared LED driver 38, and the output of the latter is connected to LED 34. An amplifier 40 and analog-to-digital converter 42 are connected in series between the detector 36 and controller 20 as illustrated. The main range controller 44 which is connected to and controls oven 10 is also connected to the controller 20.

The invention may use any of several preferred controller system configurations. For example, the sensor may be separate from the cooking device control, but still have its own processor (controller) which executes functions associated with the sensor operation (e.g., open the valve, start measurements). This processor sends to the cooking device control levels of the smoke. The cooking device control then executes the logic and generates the necessary functions (e.g., reducing the temperature). In another example configuration, the sensor is separate from the cooking device control, but still has its own processor (controller) which executes functions associated with the sensor operation (e.g., open the valve, start measurements). In addition, the processor processes the smoke level data and generates signals (messages) to the cooking device control (e.g., "reduce the cooking temperature" signal). These signals will be taken by the control and cause the control to generate the necessary functions (e.g., reducing the temperature). In the above two configurations, the controller (which is a part of the sensor) in some embodiments does not directly control the cooking device functions and does not bypass the original cooking device control. Instead it sends signals to the control. In yet another configuration, the sensor controller and the cooking device control could be in the same unit which executes all the functions including the ones associated with the sensor.

The delivery system 18 is preferably in the form of an elongated metallic tube 46 which is connected to oven 10 and to input 26 of the enclosure 22. An on-off valve 48 is interposed within tube 46 between oven 10 and chamber 16. The valve is also coupled with controller 20 which controls the on-off operation thereof.

Figure 3:
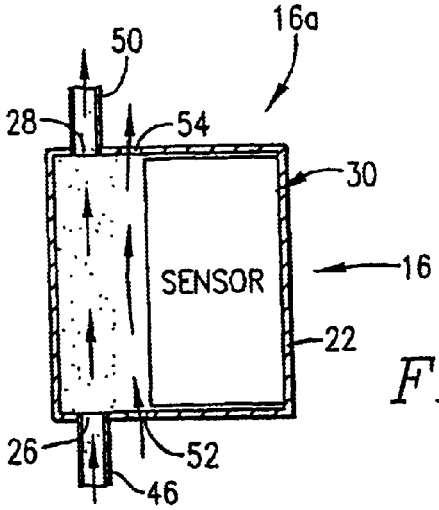
FIG. 3 is a schematic representation of a preferred smoke measuring chamber, equipped with spaced openings for drawing ambient air through the measuring chamber during use thereof.

Turning next to FIG. 3, a modified measuring chamber 16*a* is illustrated. In this case, enclosure 22 includes the oven gas inlet and outlet 26,28 with the tube 46 coupled to the former. An exhaust tube 50 is connected to oven gas outlet 28. In this instance however, the enclosure 22 is also provided with a pair of opposed openings 52, 54 which are an ambient air inlet and an ambient air outlet respectively. The openings 52, 54 are located between the oven gas inlet and outlet 26, 28, and the sensor 30.

During passage of the oven gas and smoke through the chamber 16, the smoke detector 32 is operated via controller 20 so as to repeatedly measure the smoke intensity over a period of time. Each smoke intensity measurement can be compared to a predetermined threshold. Other calculations can be performed on the measurements to determine when to activate control of the oven functions.

In more detail, it will be understood that the smoke detector 32 measures a signal proportional to light scattered from the smoke within the chamber 16. Where the FIG. 3 sensor 16*a* is used, ambient-derived air is drawn by convection through opening 52 and along the length of the chamber to and through opening 54.

This stream of ambient air is located between the sensor 30 and the oven gas and smoke passing through the sensor. Inasmuch as these flows are essentially laminar in nature, there is very little intermixing of the oven gas and ambient streams. The use of an ambient air stream is this fashion serves to protect the sensor 30 from smoke contamination and buildup of residues thereon.

Those skilled in the art will appreciate that the invention is subject to many possible variations. For example, the measuring chamber may be specially sized or configured for a particular oven and cooking duty. Furthermore, while an infrared smoke detector is preferred for reasons of cost and availability, any other type of known smoke detector could be employed. While the controller 20 is shown as separate from the main range controller 44, it will be understood that the electronics for the controlling assembly 12 may be built into the main range controller itself.

It may also be desirable to add a filter in the line 46 to separate heavy grease and oil components from the smoke entering chamber 16. This will prevent sensor contamination while still allowing smoke to enter the chamber. Furthermore, while the exhaust from the chamber 16 is shown as a tube 50, this may be replaced by one or more holes in the chamber body. Further details of a smoke sensor suitable for use with the invention can be found in the U.S. patent application entitled, Self-Cleaning Oven Having Smoke Detector For Limiting Cleaning Cycle, filed Jun. 14, 2000, in the name of Andrian Kouznetsov having a Ser. No. 09/593,341.

A second preferred embodiment of the present inventive apparatus and method uses a gas sensor and is described with reference to FIG. 1. Referring to FIG. 1, in this second embodiment, the sensor 30 is operable to detect and measure gas presences from the oven. The gas sensor provides for measurements of levels of one or more gases, such as CO2, and is able to detect food burning, food overcooking and/or fires and then provide control of features of the oven similar to those discussed above with respect to the smoke sensing embodiment. Details of a gas sensor suitable for use with the present invention can be found in the U.S. patent application entitled, A Gas Sensor Based On Energy Absorption, filed Feb. 6, 2001, in the name of Andrian Kouznetsov having a serial number not yet assigned.

Another embodiment includes smoke sensing and gas sensing together. This embodiment can use the results from either sensor or both simultaneously. In both the smoke sensing and gas sensing embodiments, and the combined embodiment, the electronics or algorithms used to interpret the signal produced by the smoke and/or gas sensor can be tailored to match the properties being measured.

The embodiments may also include a valve such that the sensor only periodically receives samples for measurement. This is desirable, for example, where the gas includes large amounts of VOCs or other undesired materials or substances that would rapidly clog the filter if it were exposed, however indirectly, to a constant flow of the gas. Alternatively or additionally, one or more in-line filters may be used to further protect the sensor 30. In embodiments having both gas and smoke sensors, both units can be integrated together if desired.

The many features and advantages of the invention are apparent from the detailed specification, and thus, it is intended by the appended claims to cover all such features and advantages of the invention which fall within the true spirits and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A cooking device controlling assembly for use with a cooking device having an interior and at least one item being cooked, said assembly comprising:

a sensing chamber;

a tube communicating the interior of said cooking device and the sensing chamber in order to convey a stream of ambient air and a stream of at least a portion of smoke and/or gas generated during cooking to the sensing chamber;

a detector associated with said chamber in order to measure a parameter of the smoke and/or gas in the chamber during cooking, wherein said stream of ambient air is located between said detector and said stream of at least a portion of the smoke and/or gas in the chamber; and a controller coupled with said detector and cooking device that controls at least one cooking device function in response to the measured parameter.

2. The assembly of claim 1, wherein the controller controls a heating temperature of the cooking device in response to the measured parameter.

3. The assembly of claim 2, wherein the controller controls a cooking time of the cooking device in response to the measured parameter.

4. The assembly of claim 1, wherein the controller controls a cooking time of the cooking device in response to the measured parameter.

5. The assembly of claim 1, wherein the controller shuts off a heating assembly of the cooking device in response to the measured parameter.

6. The assembly of claim 1, wherein the controller initiates an alarm signal in response to the measured parameter.

7. The assembly of claim 1, said smoke detector being an infrared smoke detector.

8. A cooking device controlling assembly for use with a cooking device having an interior and at least one item being cooked, said assembly comprising:

a sensing chamber;

a passageway communicating the interior of said cooking device and the sensing chamber in order to convey at least a portion of smoke generated during cooking to the sensing chamber;

a smoke detector associated with said chamber in order to measure a parameter of the smoke in the chamber during cooking;

a controller coupled with said detector and cooking device that controls at least one cooking device function in response to the measured parameter; and a valve interposed in said passageway for selectively establishing or terminating the communication between said oven interior and said chamber.

9. A cooking device controlling assembly for use with a cooking device having an interior and at least one item being cooked, said assembly comprising:

a sensing chamber;

a passageway communicating the interior of said cooking device and the sensing chamber in order to convey at least a portion of smoke generated during cooking to the sensing chamber;

a smoke detector associated with said chamber in order to measure a parameter of the smoke in the chamber during cooking;

a controller coupled with said detector and cooking device that controls at least one cooking device function in response to the measured parameter;

said chamber presenting an oven gas inlet and an oven gas outlet whereby gas from said oven including said smoke passes through the sensing chamber; and said chamber further having an ambient gas inlet and an ambient gas outlet arranged so that a stream of ambient air passes through the sensing chamber during passage of said oven gas there through, said stream of ambient air passing between said detector and said oven gas.

10. A cooking device controlling assembly for use with a cooking device having interior and at least one item being cooked, said assembly comprising:

a sensing chamber;

a tube communicating the interior of said cooking device and the sensing chamber in order to convey a stream of ambient air and a stream of at least a portion of smoke and/or gas generated during cooking to the sensing chamber;

a smoke detector associated with said chamber in order to measure a parameter of the smoke in the chamber during cooking, wherein said stream of ambient air is located between said detector and said stream of at least a portion of the smoke and/or gas in the chamber; and a controller coupled with said detector and cooking device that controls at least one oven function in response to the measured parameter.

11. The assembly of claim 10, wherein the controller controls a heating temperature of the cooking device in response to the measured parameter.

12. The assembly of claim 10, wherein the controller controls a cooking time of the cooking device in response to the measured parameter.

13. The assembly of claim 10, wherein the controller shuts off a heating assembly of the cooking device in response to the measured parameter.

14. The assembly of claim 10, wherein the controller initiates an alarm signal in response to the measured parameter.

15. The assembly of claim 10, further comprising:

a gas detector associated with said chamber in order to measure a parameter of the gas in the chamber during cooking.

16. The assembly of claim 15, said gas detector being H2O vapor detector.

17. The assembly of claim 15, said gas detector being CO2 detector.

18. The assembly of claim 10, said gas detector is a multi-component gas detector measuring concentration of several gases.

19. A cooking device controlling assembly for use with a cooking device having interior and at least one item being cooked, said assembly comprising:

a sensing chamber;

a passageway communicating the interior of said cooking device and the sensing chamber in order to convey at least a portion of at least one gas generated during cooking to the sensing chamber;

a gas detector associated with said chamber in order to measure a parameter of the gas in the chamber during cooking;

a controller coupled with said detector and cooking device that controls at least one oven function in response to the measured parameter; and a valve interposed in said passageway for selectively establishing or terminating the communication between said oven interior and said chamber.

20. A method of controlling a cooking device for cooking at least one item, said method comprising the steps of:

using a detector to measure through a tube, a parameter of (a) at least a portion of smoke emitted by the item during cooking or (b) at least one gas emitted by the item during cooking;

directing a stream of ambient air between said detector and said portion of smoke or said gas; and controlling at least one oven function in response to the measured parameter.

21. The method of claim 20, wherein the controlling step includes controlling a heating temperature of the cooking device in response to the measured parameter.

22. The method of claim 20, wherein the controlling step includes controlling a cooking time of the cooking device in response to the measured parameter.

23. The method of claim 20, wherein the controlling step includes shutting off a heating assembly of the cooking device in response to the measured parameter.

24. The method of claim 20, wherein the controlling step includes initiating an alarm signal in response to the measured parameter.

25. The method of claim 20 further comprising the step of:

using a valve in the tube to establish or terminate communication of smoke or gas interposed in said tube.

* * * * *